US005131699A

United States Patent [19]

Frestadius

[11] Patent Number: 5,131,699

[45] Date of Patent: Jul. 21, 1992

[54] LOCKING DEVICE

[75] Inventor: Klaus Frestadius, Helsinki, Finland

[73] Assignee: Temet Oy, Helsinki, Finland

[21] Appl. No.: 745,528

[22] Filed: Aug. 15, 1991

[30] Foreign Application Priority Data

Sep. 26, 1990 [FI] Finland ..... 904732

[51] Int. Cl.[5] ..... E05C 9/04

[52] U.S. Cl. ..... 292/40; 292/337

[58] Field of Search ..... 292/7, DIG. 29, DIG. 32, 292/36, 337, 167, 139, 40

[56] References Cited

U.S. PATENT DOCUMENTS

| | | | |
|---|---|---|---|
| 564,315 | 7/1896 | Sayre | 292/7 |
| 722,162 | 3/1903 | St. Louis | 292/7 |
| 1,051,918 | 2/1913 | Rowley | 292/7 |
| 2,319,982 | 5/1943 | Fralinger | 292/7 X |
| 2,742,317 | 4/1956 | Chandler | 292/DIG. 29 X |
| 3,027,188 | 3/1962 | Eichstadt | 292/DIG. 29 X |
| 4,165,894 | 8/1979 | Wojciechowski | 292/7 |
| 4,534,192 | 8/1985 | Harshbarger et al. | 292/335 X |
| 4,639,021 | 1/1987 | Hope | 292/7 |

FOREIGN PATENT DOCUMENTS

| | | |
|---|---|---|
| 672054 | 2/1939 | Fed. Rep. of Germany . |
| 3801567 | 8/1989 | Fed. Rep. of Germany . |

*Primary Examiner*—Richard E. Moore

*Attorney, Agent, or Firm*—Young & Thompson

[57] ABSTRACT

A locking device relating to a door construction to be used in an air raid shelter or the like. The door construction (1) comprises a door panel (4) arranged in a frame (3) and provided with a supporting frame (5). To make the door construction, subjected to a load, as unyielding and stable as possible, a mechanism (21 to 24) of the locking device (2) is arranged in the supporting frame (5), actual bolt members being constituted by cylinder elements (23) to be supported on the supporting frame (5) and to be arranged to comply in shape with recesses (31) of the frame (3).

2 Claims, 1 Drawing Sheet

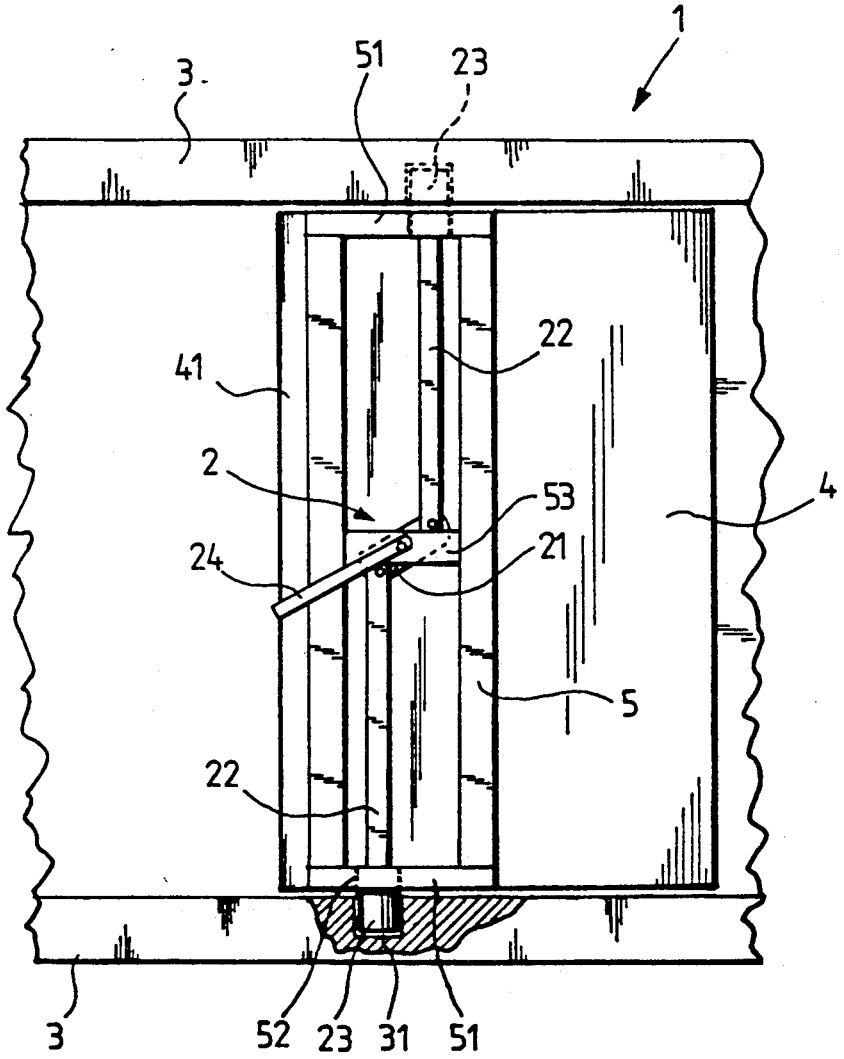
1
3
51
23
22
41
2
53
4
24
21
5
22
3
52
23
31
51

LOCKING DEVICE

FIELD OF THE INVENTION

The invention concerns a locking device relating to a door construction to be used in an air raid shelter or the like, which door construction comprises at least one door panel unit arranged in a frame, a supporting frame joined thereto the locking device arranged in the supporting frame.

BACKGROUND OF THE INVENTION

Door constructions like this are generally used as pressure doors and gas tight doors of air raid shelters and similar spaces. The doors and their locking devices are usually solid and simple in structure, e.g. in order that they would endure considerable impact stresses and compression loads and that they could be opened and closed easily and quickly and that their tightness could be secured in the long term.

In known solutions, the locking device often consists of some kind of wedge arms or bars catching behind the frame or behind a ridge formed in the frame or possibly in a reaming made into the frame. As to the actual closing function, these locking devices operate relatively satisfactorily, especially in normal circumstances. In critical situations, as for instance in connection with bomb explosions, heavy firing and the like, the drawbacks of the known solutions appear clearly, however.

Strong pressure waves caused by explosions and exponential decreases of pressure thereafter, the influence of which is mainly directed rather vertically toward the surface level of the door construction in question, make the door construction shake and tremble strongly in the horizontal direction, because the known locking devices are not able to receive such loads. In these situations occur also loads substantially parallel with the surface level of the door construction and caused by quaking ground, which loads again make the door construction shake strongly also in the vertical direction. Efforts have been made to eliminate the drawbacks of these last-mentioned loads by installing supporting frames in the door panels of the door construction, the purpose of which supporting frames is to support the door panel with respect to the frame. Their effective influence is, however, relatively small because of the fact that the door panels do not remain in place in the frame on account of the first-mentioned loads. Consequently, the result is that the locking devices get broken and the door panels finally come loose from the frame. It is quite clear that the tightness of the doors suffers already during slighter shakings and tremblings, which cannot be allowed as far as gas tight doors are concerned.

SUMMARY OF THE INVENTION

The object of the present invention is to provide a locking device relating to a door construction similar to the one in question, by means of which device the above-mentioned drawbacks can be avoided and which device makes the door construction to a substantially unyielding and stable unit when subjected to load. This object is achieved according to the invention in such a way that the supporting frame comprises a beam construction arranged in connection with one vertical edge of the door panel unit and extending substantially from the lower edge of the door panel unit to its upper edge, and that the locking device comprises a mechanism arranged in the beam construction, bolt members of the mechanism being constituted by cylinder elements, effective at the lower edge and upper edge of the door panel unit and intended to be supported on the beam construction on the one hand and to be arranged in cup-shaped recesses in the frame on the other hand, which recesses correspond to the form of the cylinder elements.

The locking device of the invention relating to a door construction is based on the idea that substantially horizontal impact stresses, compression loads and tremblings the door construction is subjected to can be received by means of the actual bolt members of the locking device. Moreover, corresponding substantially vertical loads can be made to move, thanks to the bolt members, to the beam construction arranged in the door construction and cooperating with the frame. In this way, the door construction remains stable, which makes it considerably easier to guarantee its tightness. The other components of the mechanism of the locking device are not subjected to stresses worth mentioning, due to which they can also be made simple so as to have advantageous production costs.

BRIEF DESCRIPTION OF THE DRAWINGS

One exemplifying embodiment of the invention is described in the following more closely referring to the enclosed schematic drawing showing the door construction with its locking device.

DETAILED DESCRIPTION OF THE INVENTION

The drawing shows a partial view of a door construction 1 arranged for instance in an air raid shelter or the like, in which construction an upper and a lower frame of the door, here in the form of a door panel unit 4, are indicated by the reference numeral 3. Both frames are provided with recesses 31, the purpose of which will be described more closely later on. The door panel unit 4 is on one side hinged on the frame in a usual manner (not shown). In connection of one vertical edge 41 of the door panel unit 4 is fastened a beam construction 5, mainly consisting of vertical beams extending in the vertical direction of the door and of planar supporting plates 51 at the frame of the door. The supporting plates are provided with cylindrical borings 52 corresponding to the above-mentioned recesses 31 in the frame.

To the vertical beams is fastened a transverse support 53, on which a locking device 2 relating to the door construction can be supported and articulated. In the embodiment of the drawing, a simple lever arm mechanism 21 to 24 is used, which consists of a lever 21 articulated on the transverse support 53, of two arms 22 articulated thereon and extending in the vertical direction of the door and of cylinder elements 23 articulated on the frame 3 end of each arm and constituting the actual bolt members. An actuator of the locking device is formed by a door handle 24 situated at the lever 21.

Consequently, the intention is that the lever mechanism described can be moved in a usual manner to an open and a closed position, in which latter position the cylinder elements 23 are partly arranged in the recesses 31 of the frame and partly in the borings 52 of the supporting plates 51 of the beam construction. It is appropriate to provide these applications with a minimum of play, through which the door construction becomes as stable as possible in the closed position of the door.

The substantially horizontal loads the door is subjected to are thus directed from the surface of the door to the beam construction 5 fastened to the door and further to the cylinder elements 23, while they are firmly arranged in the borings 52 of the supporting plates 51 of the beam construction. On the other hand, the cylinder elements are also firmly arranged in the recesses 31 of the frame 3, due to which the door construction as a whole forms a substantially unyielding structure staying undamaged when subjected to said loads. Thanks to their form, the cylinder elements can receive loads coming from different directions in a balanced way.

Additionally, the plays of the supporting plates 51 of the beam construction and the frame 3 are preferably of an order of some millimeters, on account of which the shakings caused by the vertical loads can be made to move to the beam construction.

The drawing and the description relating thereto are only intended to illustrate the basic idea of the invention. The details of the locking device of the invention relating to a door construction can vary within the scope of the enclosed claims. The lever mechanism described above can for instance be replaced by a system of threaded bars used by a pinion wheel arrangement and the door construction described can for instance be a double door construction.

I claim:

1. A locking device relating to a door construction to be used in an air raid shelter or the like, which door construction comprises at least one door panel unit arranged in a frame, a supporting frame joined to the door panel unit and said locking device including a lever arm application arranged in the supporting frame, said supporting frame comprising a beam construction arranged in connection with one vertical edge of the door panel unit and extending substantially from the lower edge of the door panel unit to its upper edge, and said locking device including a mechanism arranged in the beam construction, said mechanism including effective bolt members being constituted by cylinder elements arranged at the ends of said lever arm application, said cylinder elements being effective at the lower edge and upper edge of the door panel unit and adapted to be supported on the beam construction on the one hand and to be arranged in cup-shaped recesses in the frame on the other hand, said recesses corresponding to the form of the cylinder elements.

2. A locking device according to claim 1, wherein said lever arm application comprises two arms extending substantially in the vertical direction of the door panel unit, and on the ends of said arms, said cylinder elements are articulated in the vicinity of the upper and the lower edge of the door panel unit.

* * * * *